United States Patent [19]

Takao et al.

[11] Patent Number: 4,636,148

[45] Date of Patent: Jan. 13, 1987

[54] VANE TYPE COMPRESSOR WITH VOLUME CONTROL

[75] Inventors: Kunihiko Takao; Kenichi Kawashima; Yozo Nakamura, all of Ibaraki; Isao Hayase, Katsuta, all of Japan

[73] Assignee: Hitachi, Ltd., Tokyo, Japan

[21] Appl. No.: 836,110

[22] Filed: Mar. 4, 1986

Related U.S. Application Data

[63] Continuation of Ser. No. 751,592, Jul. 3, 1985, abandoned.

[30] Foreign Application Priority Data

Jan. 19, 1983 [JP] Japan ..... 58-5896

[51] Int. Cl.[4] ..... F04B 49/02

[52] U.S. Cl. ..... 417/286; 417/295; 418/259

[58] Field of Search ..... 417/286, 295, 302, 310; 418/15, 259

[56] References Cited

U.S. PATENT DOCUMENTS 2,350,537 6/1944 Scott ..... 417/295
4,452,570 6/1984 Fujisaki et al. ..... 417/295

FOREIGN PATENT DOCUMENTS 2088959 6/1982 United Kingdom ..... 418/269

*Primary Examiner*—John J. Vrablik
*Attorney, Agent, or Firm*—Antonelli, Terry & Wands

[57] ABSTRACT

A vane type compressor includes a plurality of working chambers defined by the cooperation of a rotor, a plurality of vanes and a cam ring. A valve assembly is disposed in a low pressure passage communicated with the working chambers and operative to bring a portion of the low pressure passage communicated with at least one of the working chambers to a full-closed or full-open position, to thereby effect control of the volume of gas discharged from the compressor.

7 Claims, 9 Drawing Figures

VANE TYPE COMPRESSOR WITH VOLUME CONTROL

This is a continuation of application Ser. No. 751,592, filed July 3, 1985, now abandoned.

BACKGROUND OF THE INVENTION

This invention relates to a vane type compressor for a motor vehicle air conditioning system and, more particularly, to a control of a volume of gas discharged from the compressor to save power for operating the compressor.

As one type of method of controlling the volume of gas discharged from a vane type compressor, a continuous control method has been known in which valve assemblies capable of continuously varying their respective opening degrees are respectively disposed in suction gas passages and actuated such that the opening degrees are reduced as the rotational speed of the compressor increases, for example, to thereby reduce the volume of gas discharged from the compressor. More specifically, two suction ports are provided which open in each of two working chambers, and valve assemblies are provided each of which is operable to fully open or fully close the associated suction port. In this type of compressor, one of the two suction ports opening in one of the two working chambers is closed by the associated valve assembly when the rotational speed of the compressor exceeds a predetermined value, and when a further rise in the rotational speed of the compressor results in another predetermined level being exceeded, the other suction port of the one working chamber is also closed by the associated valve assembly, so that the volume of gas discharged from the compressor can be controlled stepwise. Some disadvantages are associated with this stepwise control process. One of them is that with the degree of openings of the suction ports being limited or restricted, the gas flowing into the working chamber would be low in density and pressure as it is compressed. The result of this would be that the temperature of the gas discharged from the compressor would rise as the opening degrees of the valve assemblies drop, thereby causing durability of the compressor to be decreased.

In another known control method, inflow of gas into the plurality of working chambers of the compressor is successively blocked as the rotational speed of the compressor rises, so that the number of working chambers rendered inoperative will increase to successively reduce the volume of gas discharged from the compressor. When this control method is used, the durability of the compressor would also be lowered because the absence of gas would result in a rise in the temperature of the working chambers which are inoperative, so that a rise in the temperature of the components of the compressor would cause a shortening of their service life.

SUMMARY OF THE INVENTION

This invention has as its object the provision of a vane type compressor capable of controlling the volume of gas discharged from the compressor without adversely affecting the durability of the compressor.

According to the present invention, there is provided a vane type compressor comprising a rotor and a cam ring defining therebetween a compression space divided into a plurality of working chambers by rotor vanes, and valve means for effecting two-step control of a suction passage communicated with at least one of the working chambers such that the entire suction passage is fully opened or fully closed, to render the specific working chamber inoperative to thereby control the volume of gas discharged from the compressor.

DETAILED DESCRIPTION OF THE PREFERRED EMBODIMENT

A preferred embodiment of the invention will now be described by referring to the accompanying drawings.

Figure 1:
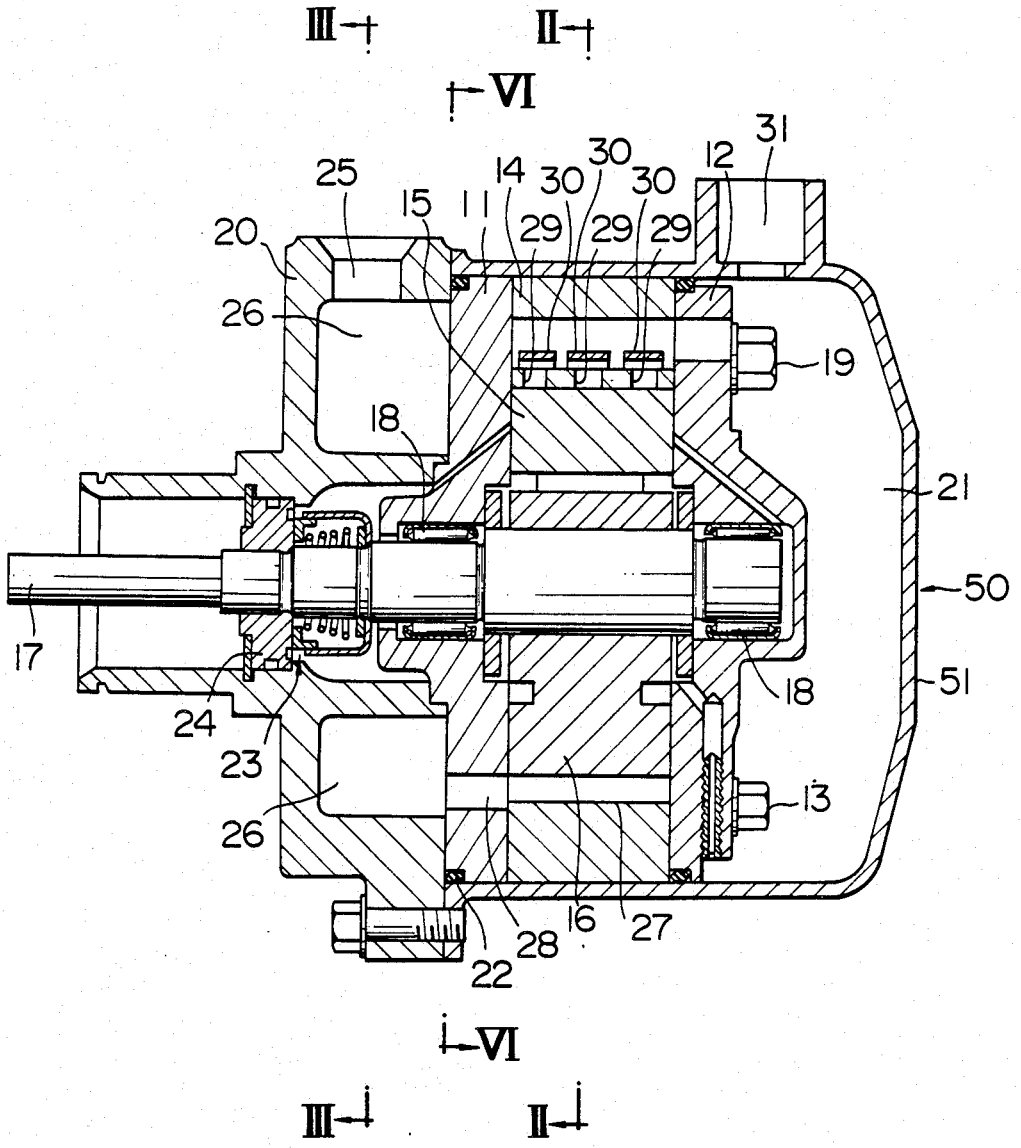
FIG. 1 is a sectional view of the vane type compressor according to an embodiment of the invention.
Figure 2:
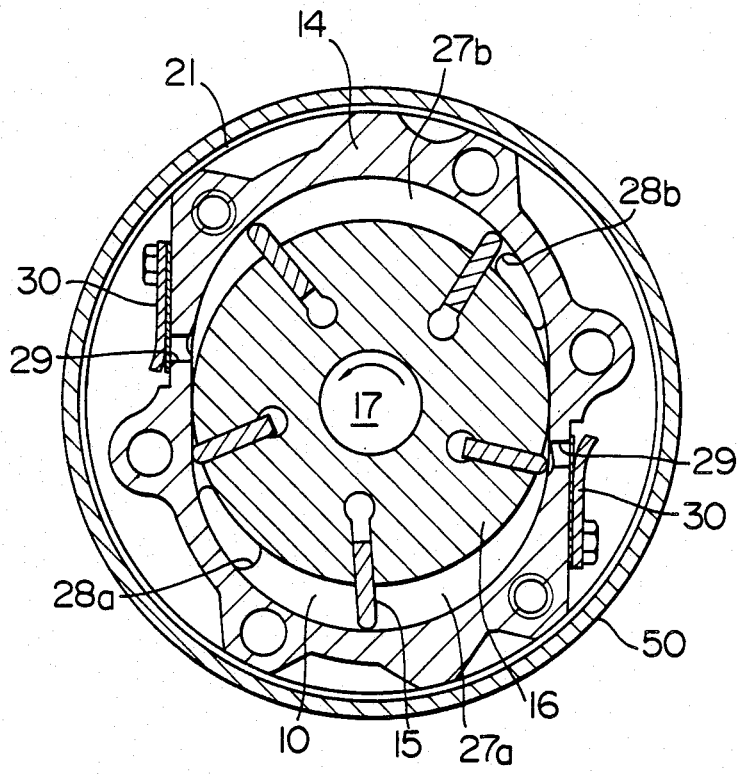
FIG. 2 is a sectional view taken along the line II—II in FIG. 1.

Referring now to the drawings wherein like reference numerals are used throughout the various views to designate like parts and, more particularly, to FIGS. 1 and 2, according to these figures, a compressor comprises a front plate 11, a rear plate 12 and a cam ring 14 fastened to the plates 11 and 12 by bolts 13, to define a compression space in which a rotor 16, equipped with a plurality of vanes 15 movable in and out of the rotor 16, is supported by a drive shaft 17.

The drive shaft 17 is supported by the front and rear plates 11 and 12 through needle bearings 18. The front and rear plates 11 and 12 and cam ring 14 are secured to a front cover 20 by through bolts 19. A cup-shaped rear cover member generally designated by the reference numeral 50 is fastened by suitable fasteners to the front cover 20 in a manner to enclose the front and rear plates 11 and 12 and the cam ring 14 and has a bottom wall 51 which cooperates with the rear plate 12 to define therebetween a discharge chamber 21. The rear cover member 50 is gas-tightly connected to the front cover 20 by means of an O-ring 22 and provides a shaft seal to the drive shaft 17 in cooperation with a rotary member 23 secured to the drive shaft 17 and a cover plate 24 secured to the front cover 20.

Referring to FIG. 2, the cam ring 14 and rotor 16 cooperate with each other to define therebetween two working chambers **27*a* and 27*b*. The front plate 11 is formed with two suction ports 28*a* and 28*b*. Each pair of adjacent vanes 15 cooperate with an outer peripheral surface of the rotor 16 and an inner peripheral surface of the cam ring 14 to define therebetween a compression chambers 10** (which is five in this embodiment).

As shown in FIGS. 1 and 2, the refrigerant returning to the compressor from the refrigeration cycle is admitted into a low pressure passage 26 formed in the front cover 20 through a suction port 25 also formed therein. The refrigerant flows from the low pressure passage 26 through the suction ports 28 (28*a* and 28*b*) formed in the front plate 11 into the compression chambers 10. As the drive shaft 17 rotates, each of the compression chambers 10 has its volume reduced successively from a maximum through a compression stroke, and the refrigerant thus compressed is discharged through discharge ports 29 in the cam ring 14 and discharge valves 30 mounted thereon into the discharge chamber 21, when its pressure reaches a discharge pressure. In the discharge chamber 21, the oil entrained in the refrigerant is separated by an oil separator, not shown, and the refrigerant is fed through a discharge port 31 of the compressor formed in the rear cover member 50 into the refrigerant cycle again.

By bringing any one of the suction ports 28*a* and 28*b* or a portion of the passage 26 communicating therewith to a fully-closed position, it is possible to render one of the working chambers 27*a* and 27*b* inoperative to compress gas while allowing the other working chamber to perform gas compression. In this specification, the operation of the compressor described hereinabove will be referred to as a partial-load operation. Meanwhile, the operation of compressing gas by drawing the gas through the two suction ports 28*a* and 28*b* will be referred to as a full-load operation. Thus, in the partial-load operation, the volume of gas discharged from the compressor will be one-half the volume of gas discharged therefrom in the full-load operation.

Figure 3:
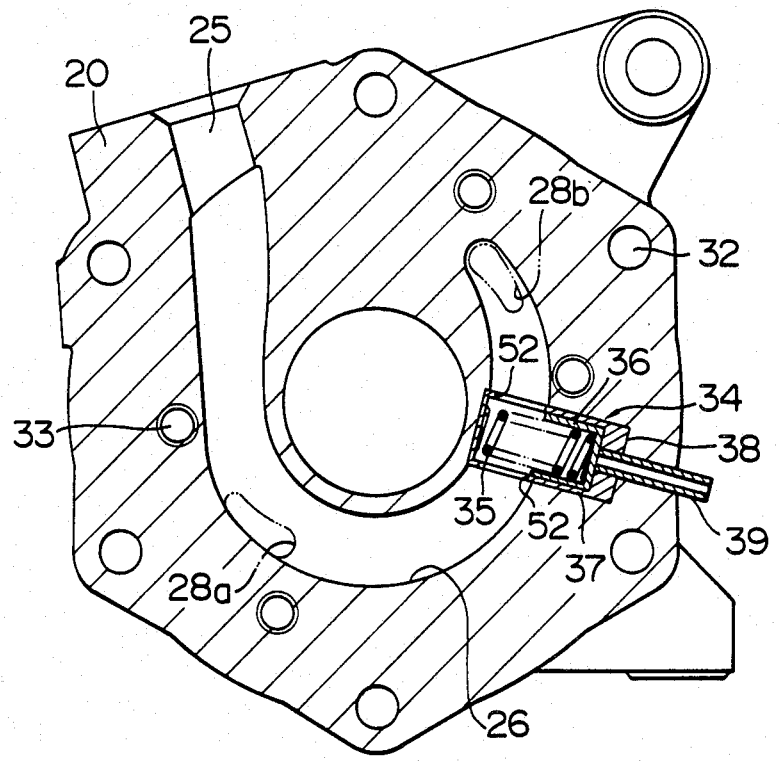
FIG. 3 is a sectional view taken along the line III—III in FIG. 1, showing the suction ports in phantom lines for the sake of convenience, although they are not actually visible, while eliminating the drive shaft in the interest of clarity.

As shown in FIG. 3, the front cover 20 is formed with six bolt holes 32 for fastening the front cover 20 to a fixed part, not shown, and four bolt holes 33 for fastening the front and rear plates 11 and 12 and the cam ring 14 to the front cover 20. The low pressure passage 26 extends substantially in vortical form in the direction of rotation of the rotor 16 (counterclockwise in FIG. 3) and a forward end of the passage 26 does not reach the suction port 25 of the compressor and is not in communication therewith. Thus, the gas flows through the low pressure passage 26 only in one direction. The suction ports 28*a* and 28*b* are both normally maintained in communication with the low pressure passage 26. A valve assembly generally designated by the reference numeral 34 is disposed in the low pressure passage 26 in such a manner that it opens or closes a portion of the low pressure passage 26 which is communicated with the suction port located on the downstream side with respect to the flow of suction gas (suction port 28*b* in FIG. 3). The valve assembly 34 is arranged such that a cup-shaped piston 36, urged by the biasing force of a coil spring 35 and the pressure of the working gas so as to move radially in reciprocatory movement, is slidably located in a cylinder chamber defined by a cylinder 37 and a cylinder head 38, and the cylinder head 38 has connected thereto a pipe 39 for introducing therethrough the working gas into the cylinder 37.

Figure 4:
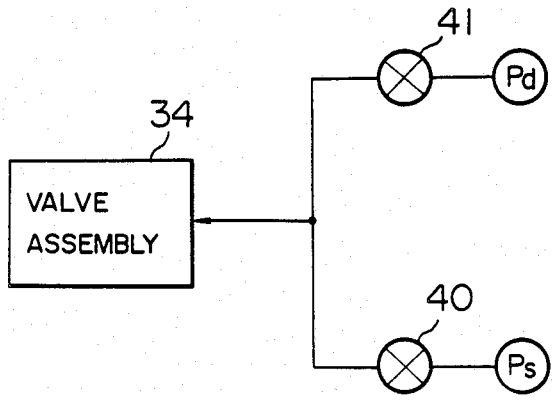
FIG. 4 is a diagram showing the circuit for operating the actuator shown in FIG. 3.

As shown in FIG. 4, when the full-load operation is performed, a solenoid actuated valve 40 is opened and another solenoid-actuated valve 41 is closed, and a pressure applies to the cylinder head 38 is rendered equal to the suction pressure $P_s$ prevailing in the low pressure passage 26. At this time, the piston 36 is urged by the biasing force F of the coil spring 35 to move radially outwardly to cause a communicating port 52 formed in the wall of the cylinder 37 to be fully opened so as to allow a refrigerant gas to flow from the low pressure passage 26 into the working chamber 27*b*. When the full-load operation is switched to the partial-load operation, the solenoid-actuated valves 40 and 41 are closed and opened, respectively. This causes the gas under the discharge pressure $P_d$ to exert a force $F_d$ on the piston 36 to urge same to move radially inwardly. Thus, the piston 36 is moved radially inwardly or toward the axial center of the front cover 20 by a force $F_d - F$, to thereby close the communicating port 52. This blocks the supply of the refrigerant gas to the suction port 28*b*, allowing the compressor to perform a partial-load operation.

As described hereinabove, the valve assembly 34 is located in the low pressure passage 26 of vortical form and operative to block the supply of the refrigerant gas to the suction port 28*b* located on the downstream side with respect to the flow of the suction gas through the low pressure passage 26, so that it is possible to utilize the inertial and pulsation effects of the suction refrigerant gas flowing through the passage 26. This is conducive to increased volume efficiency of the working chamber 27 communicated with the suction port 38*a* on the upstream side with respect to the flow of the refrigerant suction gas through the passage 26 and lowered discharge gas temperature.

The operation of the valve assembly 34 may be controlled as follows. In one aspect, the degree of opening of the communicating port 52 formed in the cylinder 37 is continuously varied (which is referred to as a continuous control), and in another aspect, the communicating port 52 is moved between a full-open position and a full-closed position (which is referred to as an on-off control). The continuous control process suffers the disadvantage that, when the communicating port 52 has an intermediate degree of opening, a pressure loss $\Delta P$ due to the throttling action of the valve assembly increases. Generally, the influences exerted by a pressure loss on the volume efficiency and the discharge gas temperature of a compressor can be expressed by the following equations (1) and (2):

$$\Delta\eta_v = \eta_v\left(\frac{v_i}{v_s} - 1\right) \tag{1}$$

where $\Delta\eta_v$: reduction in volume efficiency;

$\eta_v$: volume efficiency of compressor;

$v_i$: specific volume of refrigerant gas flowing through valve assembly 34; and $v_s$: specific volume of refrigerant gas at suction port of compressor.

$$T_d = T_s\left(\frac{P_d}{P_i}\right)^{\frac{k-1}{k}} \tag{2}$$

where $T_d$: discharge gas temperature of compressor;

$T_s$: refrigerant gas temperature at suction port of compressor;

$P_d$: discharge gas pressure;

$P_i$: pressure of refrigerant gas flowing through valve assembly 34; and k: heat insulation index.

Figure 5:
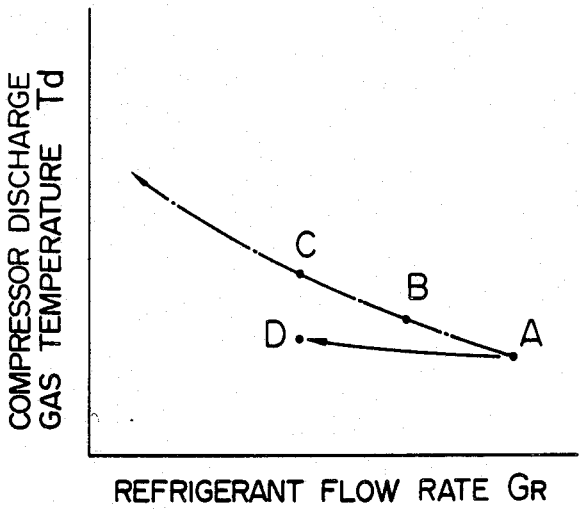
FIG. 5 is a diagram showing the characteristics of the embodiment of the compressor in accordance with the invention and that of the prior art, in comparison with each other.

In equation (1), the value of $v_i$ is increased by $\Delta P$, so that $\Delta\eta_v$ becomes large in value. States differently, in the continuous control, the volume of gas discharged from the compressor is controlled by reducing the volume efficiency of the compressor. Assuming that $T_s$ and $P_d$ are constant in the equation (2), the value of $P_i$ increases due to $\Delta P$ and the value of $T_d$ or the discharge gas temperature of the compressor rises. As a result, a curve representing the compressor discharge gas temperature-refrigerant flow rate characteristic shifts from A to B and C as shown in FIG. 5, thereby giving rise to the disadvantage that the durability of the compressor is adversely affected.

By contrast, in the on-off control process which is used in the embodiment of the invention, the communicating port 52 is brought to a full-closed position, so that no refrigerant flows to the working chamber connected to the portion of the low pressure passage 26 which is closed by the valve assembly 34 and no appreciable rise occurs in the temperature of the gas discharged from the compressor. As shown in FIG. 5, the temperature of the gas discharged from the compressor shows almost no rise as indicated by a curve A–D, so that the aforesaid problem can be avoided.

Figure 6:
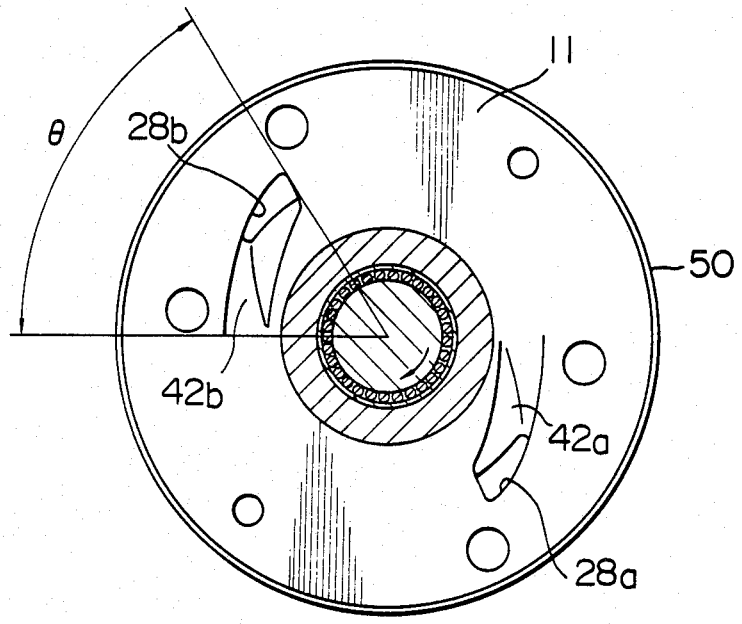
FIG. 6 is a sectional view taken along the line VI—VI in FIG. 1.
Figure 7:
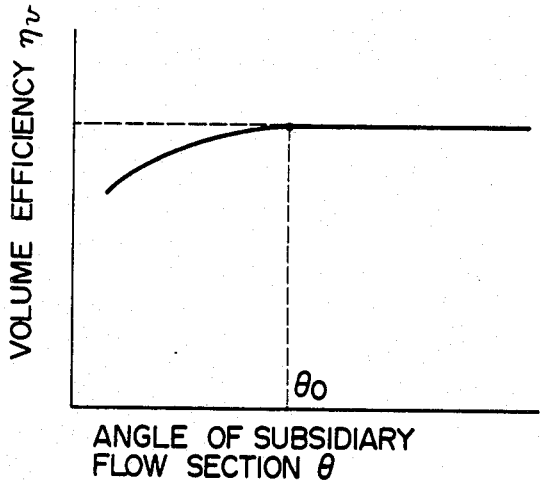
FIG. 7 is a diagram showing the characteristics of the embodiment of the compressor in accordance with the invention, obtained as the results of experiments.

Generally speaking, the valve assembly 34 is located at a position between the two suction ports **28*a*, 28*b*. However, the location of the assembly 34 is determined in accordance with the performance of the compressor and the like. As shown in FIG. 6, the front plate 11 is formed with subsidiary flow sections 42*a* and 42*b* each having a sloped recess which are located on the upstream side of the suction ports 28*a* and 28*b*, respectively, with respect to the direction of rotation of the rotor 16 (clockwise in the figure) in positions where the subsidiary flow sections 42*a* and 42*b* abut against the low pressure passage 26 in generally vertical form. With respect to the suction port 28*b* located on the downstream side of the valve assembly 34, the length of the subsidiary flow section 42*b* is indicated by an angle $\theta$ formed by a radial line connecting the center of the rotor 16 to a suction terminating point of the suction port 28*b* and a radial line connecting the center of the rotor 16 to a point located in a position opposite to the direction of rotation of the rotor 16. FIG. 7 shows the results of experiments conducted on the relation between the angle $\theta$ and the volume efficiency $\eta_v$ of the compressor. As can be clearly seen in FIG. 7, there is a point at which no rise in the value of $\theta_v$ occurs after the value of $\theta$ has reached a certain level, even if the value of $\theta$ is further increased. Let the value of $\theta$ at such point be denoted by $\theta_o$, and the position at which the valve assembly 34 is located be indicated by $\theta_p$. Then, one only has to obtain the following relation: $\theta_p \geqq \theta_o$. With respect to the suction port 28*a* located on the upstream side of the valve assembly 34, a position at which a reduction in the volume efficiency of the working chamber 27*a* communicated with the suction port 28*a* can be avoided by the negative pulsation waves of a stream of suction refrigerant gas flowing through the low pressure passage 26 and valve assembly 34 can be determined. Let such position be designated by a point located in a direction opposite the direction of rotation of the rotor 16 with respect to the suction terminating point of the suction port 28*b* and cooperating therewith to form an angle $\theta_1$. Then, $\theta_p \leqq \theta_1$. Thus, one only has to dispose the valve assembly 34** in a position in which the relation $\theta_1 \geqq \theta_p \geqq \theta_o$ is satisfied.

Figure 8:
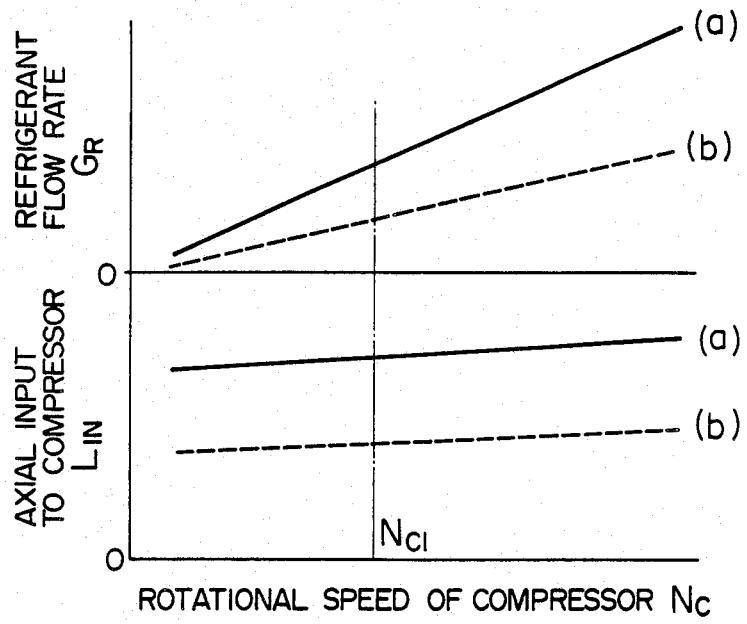
FIG. 8 is a diagram showing the rotational speed of the embodiment of the compressor in accordance with the invention in relation to the flow rate of a refrigerant and the axial input to the compressor.

FIG. 8 is a diagram showing the results of experiments conducted on the full-load and partial-load operations of the compressor by keeping the suction pressure and temperature and the discharge pressure and temperature constant, to obtain the relationship between the rotational speed of the compressor $N_c$, the compressor axial input $L_{IN}$ and refrigerant flow rate $G_R$ through the refrigeration cycle. In FIG. 8, a curve (a) represents the full-load operation and a curve (b) indicates the partial-load operation. It will be seen in FIG. 8 that, if the compressor is switched from the full-load operation to the partial-load operation when the rotational speed of the compressor exceeds a value $N_{cl}$, then the refrigerant flow rate is reduced to one-half the refrigerant flow rate obtained during the full-load operation and the compressor axial input can also be reduced to one-half in value.

Figure 9:
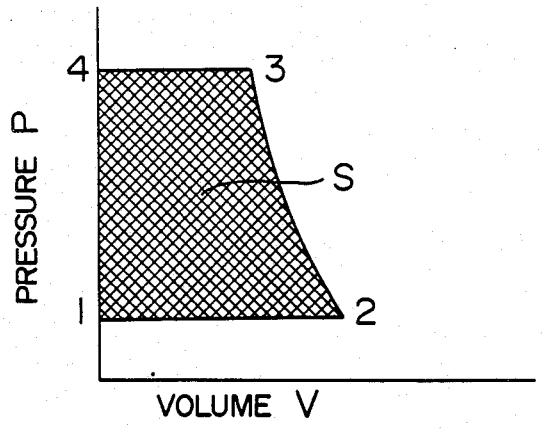
FIG. 9 is a schematic indicator diagram.

FIG. 9 is a schematic indicator diagram in which the power required for performing a full-load operation can be expressed as $S \times 5 \times 2$ and the power required for performing a partial-load operation can in expressed as $S \times 5 \times 1$ where S designates an area surrounded by lines 1–2, 2–3, 3–4 and 4–1. Thus, it will be seen that by switching the compressor from the full-load operation to the partial-load operation, the power required can be reduced to one-half.

In the above described embodiment, one of the two working chambers located in the same axial right-angle cross-section is inoperative for suction and compression. States differently, the rotor 16 and the vanes 15 move alternately through one working chamber which is operative and the other working chamber which is inoperative. Thus, the heat generated by friction between the tips of the vanes 15 and the cam ring 14 or between the vanes 15 and vane grooves formed in the rotor 16 when the working chamber is inoperative can be absorbed by the suction gas when the rotation of the rotor 16 causes the vanes 15 to perform compression in the working chamber which is operative, to thereby cool the vanes 15. This is conductive to prevention of adversely affecting of the durability of the vanes. In the above-described embodiment shown, the suction ports **28*a*, 28*b* have been shown as being located in series in the low pressure passage 26 formed in the front cover 20. However, this is not restrictive and the low pressure passage 26 may be divided into two branches respectively leading to the two suction ports from the suction port 25 formed in the front cover 20. Such branches would terminate at the open end of the suction port 25** and one of these branches would be brought to a full closed position.

From the foregoing description, it will be appreciated that the invention enables the volume of gas discharged from the vane type compressor to be controlled by a system in which one of the working chambers is rendered inoperative, so that control of discharged gas volume can be effected without adversely affecting the durability of the compressor while allowing the axial input to the compressor to be reduced as the gas is compressed.

What is claimed is:

1. A vane type compressor comprising:

a cam ring;

a rotor rotatably mounted within said cam ring;

a plurality of vanes mounted in said rotor;

a rear plate and a front plate disposed so as to close opposite ends of said cam ring;

a refrigerant inlet means for said compressor;

each pair of adjacent vanes cooperating with said cam ring and said rotor to define a working chamber;

suction ports formed in said front plate and successively communicatable with the working chambers when said rotor is rotated;

a front cover abutting against said front plate and having formed therein a low pressure passage means in the form of a vortex in the rotational direction of said rotor, said low pressure passage means having an upstream end in communication with said refrigerant inlet means and having a dead end in a downstream end, said suction ports opening to said low pressure passage means for allowing said refrigerant inlet means to communicate with said working chambers through said suction ports; and valve means mounted in said front cover for controlling in an ON-OFF manner, a portion of said low pressure passage so as to fully open the same to allow said refrigerant inlet means to communicate with said working chambers through said suction ports and so as to fully close said portion of said low pressure passage means to prevent said refrigerant inlet means from communicating with said working chambers through at least one of said suction ports while continuously maintaining said refrigerant inlet means in communication with said working chambers through the remaining at least one suction port.

2. A vane type compressor according to claim 1, wherein said valve means includes piston means, a cylinder means for slidably accommodating the piston means, means for enabling an introduction of a working gas into the cylinder means, means for biasing the piston means in a direction opposite the force of the working gas, and means formed in the cylinder means for communicating the cylinder means with the low pressure passage means.

3. A vane type compressor according to claim 2, wherein said suction ports include a pair of suction ports in communication with the low pressure passage means, and wherein said valve means is disposed between said pair of suction ports.

4. A vane type compressor according to claim 1, wherein said suction ports includes at least a pair of suction ports, said front plate is provided with subsidiary flow sections each having a sloped recess on an upstream side of the respective suction ports, as viewed in a direction of rotation of the rotor, and wherein the valve means is located between said pair of suction ports in accordance with the following relationship:

$$\theta_1 \geqq \theta_p \geqq \theta_0,$$

wherein:

$\theta_1$ is the length of the subsidiary flow section associated with the suction port located on a downstream side of the valve means, $\theta_p$ is the position in which the valve means is located, and $\theta_0$ is a position at which the volume efficiency of the compressor is maximized.

5. A vane type compressor according to claim 1, wherein said suction ports includes a pair of suction ports in communication with the low pressure passage means, and wherein said valve means is disposed between said pair of suction ports.

6. A vane type compressor according to claim 1, wherein said suction ports comprise first and second suction ports, said first suction port opening to an area of said low pressure passage means, adjacent to the downstream dead end thereof and said second suction port opens to an area of said low pressure passage means between the upstream and downstream ends thereof, said valve means being disposed between said first and second suction ports, said refrigerant inlet means being in communication with said working chambers through said first and second suction ports when said valve means fully opens said low pressure passage means, and said refrigerant inlet means being in communication with said working chambers through said second suction port, but prevented from communicating with said working chambers through said first suction port when said valve means fully closes said portion of said low pressure passage means.

7. A vane type compressor according to claim 6, wherein said front plate is provided with subsidiary flow sections each having a sloped recess on an upstream side of the respective suction ports, as viewed in a direction of rotation of the rotor, and wherein the valve means is located between said pair of suction ports in accordance with the following relationship:

$$\theta_1 \geqq \theta_p \geqq \theta_0,$$

wherein:

$\theta_1$ is the length of the subsidiary flow section associated with the suction port located on a downstream side of the valve means, $\theta_p$ is the position in which the valve means is located, and $\theta_0$ is a position at which the volume efficiency of the compressor is maximized.

* * * * *